US008217287B2

(12) United States Patent
Kil

(10) Patent No.: US 8,217,287 B2
(45) Date of Patent: Jul. 10, 2012

(54) SWITCHING MECHANISM FOR MOTOR PROTECTION CIRCUIT BREAKER

(75) Inventor: Hwan-Chang Kil, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 311 days.

(21) Appl. No.: 12/550,503

(22) Filed: Aug. 31, 2009

(65) Prior Publication Data

US 2010/0059350 A1 Mar. 11, 2010

(30) Foreign Application Priority Data

Sep. 8, 2008 (KR) ..... 10-2008-0088446

(51) Int. Cl.
*H01H 3/20* (2006.01)

(52) U.S. Cl. ..... 200/332

(58) Field of Classification Search ..... 200/332, 200/400–401, 318–327; 361/30; 335/167–174, 335/21–23

See application file for complete search history.

(56) References Cited

U.S. PATENT DOCUMENTS

| | | | | |
|---|---|---|---|---|
| 5,027,092 | A | 6/1991 | Castonguay et al. | |
| 6,160,234 | A * | 12/2000 | Wehrli, III et al. | 200/400 |
| 7,397,008 | B2 * | 7/2008 | Ahn et al. | 200/400 |
| 7,977,592 | B2 * | 7/2011 | Shmukler et al. | 200/244 |
| 2003/0178392 | A1 | 9/2003 | Kim et al. | |
| 2005/0139462 | A1 | 6/2005 | Shin | |

FOREIGN PATENT DOCUMENTS

| | | |
|---|---|---|
| CN | 101183622 | 5/2008 |

OTHER PUBLICATIONS

China Office action, mail date is Dec. 16, 2011.

* cited by examiner

*Primary Examiner* — Edwin A. Leon
(74) *Attorney, Agent, or Firm* — Greenblum & Bernstein P.L.C.

(57) ABSTRACT

A switch for a motor protection circuit breaker capable of reducing a force required to adjust a handle and capable of enhancing the reliability to break a circuit. The switch includes a push link having an outer circumferential curved surface of a varying cam profile, so as to enhance a function to break the circuit by pressing movable contact plates.

6 Claims, 3 Drawing Sheets

SWITCHING MECHANISM FOR MOTOR PROTECTION CIRCUIT BREAKER

RELATED APPLICATION

The present disclosure relates to subject matter contained in priority Korean Application No. 10-2008-0088446, filed on Sep. 8, 2008, which is herein expressly incorporated by reference in its entirety.

BACKGROUND OF THE INVENTION

1. Field of the Invention

The present invention relates to a motor protection circuit breaker, a so-called 'manual motor starter', and particularly, to a switching mechanism for a motor protection circuit breaker capable of reducing a force required to operate a handle, and capable of enhancing the reliability to break a circuit.

2. Background of the Invention

A motor protection circuit breaker, so-called a 'manual motor starter' (MMS) is an apparatus having a switching function for starting or stopping an electric motor, and having a protection function for protecting the electric motor by automatically breaking a circuit upon the occurrence of an abnormal current such as a short current on the circuit.

The conventional switching mechanism for a motor protection circuit breaker comprises a handle, a link mechanism, a push link, and a movable contact mechanism.

The handle provides a means to manually operate the motor protection circuit breaker to an 'ON' position (conducting position), or an 'OFF' position (circuit breaking position).

The link mechanism transmits an operating force by the handle for the 'ON' position or 'OFF' position.

The push link is rotated by the link mechanism, thereby providing the operating force to open and close the circuit.

The movable contact mechanism is movable to a position contacting a fixed contact, or a position separated from the fixed contact according to whether a pressure applied from the push link exists or not. Here, the movable contact mechanism includes movable contact plates and a cross bar. The movable contact plates are provided in three in number, for example, for three-phases (R phase, S phase, and T phase) alternating current. Contactor is attached to each of the movable contact plates for three-phase. The cross bar is a means to transmit an operating force to open and close the circuit generated by the push link, to the plurality of movable contact plates.

The conventional switching mechanism for a motor protection circuit breaker further comprises a latch and a trip spring for automatically breaking the circuit upon the occurrence of an abnormal current.

The latch is a means connected to the link mechanism, and displaceable to a position for locking the link mechanism or a position for releasing the locked state of the link mechanism.

The trip spring is a means to provide a driving force for breaking a circuit. Contact pressure springs for maintaining a contact pressure with the fixed contacts are installed below the movable contact plates for three-phase, respectively.

In the case of rotating the handle to an 'OFF' position by a user, the rotational force of the handle is transmitted to the push link via the link mechanism. As the push link is rotated, the cross bar is downwardly pressed. Accordingly, the cross bar overcomes the contact pressure by the contact pressure springs, and downwardly presses the movable contact plates for three-phase. This may allow the movable contacts attached to the movable contact plates for three-phase to be separated from the fixed contacts. As a result, an 'OFF' state that the circuit is artificially broken is implemented.

Upon the occurrence of an abnormal current such as a short current on the circuit, the latch is released by a trip mechanism including a trip coil (not shown) for generating a trip driving force by being magnetized by the abnormal current. As a result, by elastic energy discharged from the trip spring, the push link connected to the trip spring is rotated. The push link being rotated downwardly presses the cross bar. Accordingly, the cross bar overcomes the contact pressure by the contact pressure springs, and downwardly presses the movable contact plates for three-phase. This may allow the movable contacts attached to the movable contact plates for three-phase to be separated from the fixed contacts. As a result, a 'TRIP' state is implemented.

In the case of rotating the handle to an 'ON' position by the user, the rotational force of the handle is transmitted to the push link via the link mechanism. As the push link is rotated in an opposite direction to the 'OFF' direction, the cross bar is released. Accordingly, the movable contact plates for three-phase are upwardly moved by the contact pressure by the contact pressure springs. This may allow the movable contacts attached to the movable contact plates for three-phase to contact the fixed contacts. As a result, an 'ON' state that the circuit is closed is implemented.

In the conventional switching mechanism for a motor protection circuit breaker, in order to implement a closed circuit (conducting state) that the movable contacts contact the fixed contacts as the cross bar and the movable contact plates for three-phase upwardly move, the cross bar and the push link have to be separated from each other with a predetermined distance therebetween in an 'ON' state. Accordingly, in order to rotate the push link so as to be separated from the cross bar by a predetermined distance, a large operating force of the handle was required, the operating force large enough to overcome an elastic force of the trip spring, and enough to rotate the push link. Furthermore, in order to manually operate the conventional switching mechanism for a motor protection circuit breaker to an 'OFF' state from an 'ON' state, also required was an operating force large enough to overcome an elastic force of the trip spring, and enough to rotate the push link toward an 'OFF' direction. That is, there has been required a large force for a user to operate the handle in an 'ON' or 'OFF' direction.

The conventional switching mechanism for a motor protection circuit breaker has the following problems.

Firstly, it was difficult to decrease an operating force of the handle while satisfying a condition that the cross bar and the push link have to be separated from each other with a predetermined distance therebetween, in an 'ON' state.

Secondly, due to an incomplete releasing operation of the latch, the switching mechanism may perform an incomplete circuit opening operation (trip operation). This results in a problem that breaking the circuit upon the occurrence of an abnormal current may fail. Accordingly, has been required a method for reducing an operating force of the handle, and for automatically or manually breaking the circuit with an enhanced reliability.

SUMMARY OF THE INVENTION

Therefore, an object of the present invention is to provide a switching mechanism for a motor protection circuit breaker capable of reducing a force required to adjust a handle, and capable of enhancing the reliability to break a circuit.

To achieve these and other advantages and in accordance with the purpose of the present invention, as embodied and broadly described herein, there is provided a switching mechanism for a motor protection circuit breaker, comprising a push link having an outer circumferential curved surface of a varying cam profile, so as to enhance a function to break a circuit by pressing movable contact plates.

According to another aspect of the present invention, there is provided a switching mechanism for a motor protection circuit breaker, comprising: a handle which provides a means to manually adjust a motor protection circuit breaker to an 'OFF' position or an 'ON' position; fixed contacts; movable contacts configured to be movable to an 'ON' position contacting the fixed contacts, and an 'OFF' position or a 'TRIP' position separated from the fixed contacts; movable contact plates configured to support the movable contacts; a link mechanism connected to the handle, and configured to transmit a manual operating force; a latch connected to the link mechanism, and displaceable to a position for locking the link mechanism and a position for releasing the locked state of the link mechanism; and a trip spring configured to provide a driving force for breaking a circuit, wherein the switching mechanism for a motor protection circuit breaker further comprises a push link rotatable to a position to break the circuit by pressing the movable contact plates, and to a position not contacting the movable contact plates, having a part connected to the link mechanism and a part connected to the trip spring, and having an outer circumferential curved surface of a varying cam profile so as to enhance a function to break the circuit by pressing the movable contact plates.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Figure 1:
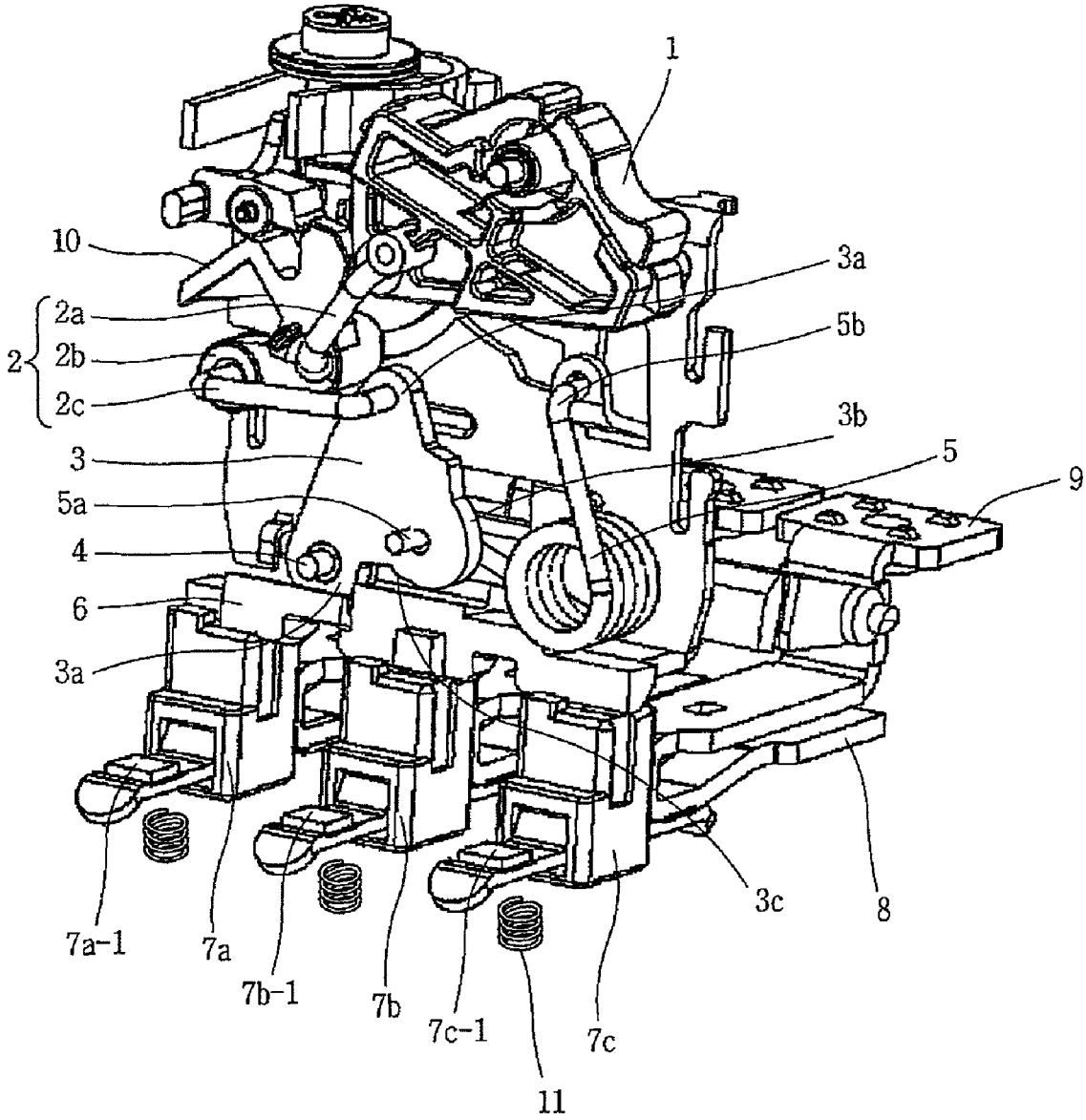
FIG. 1 is a perspective view showing a configuration of a switching mechanism for a motor protection circuit breaker according to the present invention.
Figure 2:
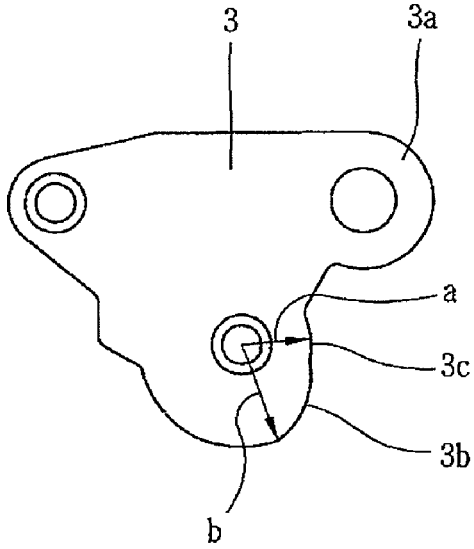
FIG. 2 is a frontal view showing a configuration of a push link of the switching mechanism for a motor protection circuit breaker according to the present invention.

FIG. 1 is a perspective view showing a configuration of a switching mechanism for a motor protection circuit breaker according to the present invention, and FIG. 2 is a frontal view showing a configuration of a push link of the switching mechanism for a motor protection circuit breaker according to the present invention.

With reference to FIGS. 1 and 2, the switching mechanism for a motor protection circuit breaker according to the present invention will be explained.

The switching mechanism for a motor protection circuit breaker according to the present invention comprises a push link 3 having an outer circumferential curved surface of a varying cam profile, i.e., a varying curvature radius, so as to enhance a function to break a circuit by pressing movable contact plates 7*a*, 7*b* and 7*c*. The push link 3 may be formed of a metallic plate. To three vertexes of the push link 3 having an approximate triangular shape, connected are a rotation shaft 4, a third link 2*c* configured to provide a manual rotation driving force by a handle 2, and a trip spring 5 configured to provide an elastic force as a driving force to automatically break the circuit at the time of a trip operation. The push link 3 is movable to a position to break the circuit by pressing the movable contact plates 7*a*, 7*b* and 7*c* through a cross bar 6 that will be later explained, and to a position to stop the pressing of the movable contact plates 7*a*, 7*b* and 7*c* through the cross bar 6.

Hereinafter, the vertex of the push link 3, to which the third link 2*c* is connected will be referred to as a link connecting portion 3*a*.

Referring to FIG. 2, the outer circumferential curved surface of the push link 3 includes a first outer circumferential portion 3*c* having a first curvature radius (a), and a second outer circumferential portion 3*b* having a second curvature radius (b) larger than the first curvature radius (a) by a predetermined size. Preferably, the predetermined size is 1.5 mm.

One end 5*a* of the trip spring 5 is connected to one vertex of the push link 3, whereas another end 5*b* of the trip spring 5 is fixed onto a side plate that constitutes a base plate of the switching mechanism.

The push link 3 can be rotated centering around a rotation shaft 4 by a rotation driving force transmitted through the third link 2*c* that will be later explained.

The switching mechanism for a motor protection circuit breaker according to the present invention comprises a push link 3 having an outer circumferential curved surface of a varying cam profile. Accordingly, when the second outer circumferential portion 3*b* having the second curvature radius (b) larger than the first curvature radius (a) pushes the cross bar 6, the movable contact plates 7*a*, 7*b* and 7*c* can be vertically moved by a large displacement amount. This makes a spacing distance of movable contacts 7*a*-1, 7*b*-*b* and 7*c*-1 from fixed contacts 8 long. The movable contact plates 7*a*, 7*b* and 7*c* can make a large displacement even by a small rotation angle of the push link 3, thereby enhancing a function to break the circuit.

Referring to FIG. 1, the switching mechanism for a motor protection circuit breaker according to the present invention comprises a handle 1 positioned at the upper side, and serving as a means to manually operate a motor protection circuit breaker to an 'ON' position (conducting position) or an 'OFF' position (circuit breaking position).

The switching mechanism for a motor protection circuit breaker according to the present invention further comprises a link mechanism 2 connected to the handle 1 and configured to transmit a manual operating force, i.e., an operating force of the handle 1 to an 'ON' position or an 'OFF' position. The link mechanism 2 includes a first link 2*a* connected to the handle 1 and rotatably arranged at the upper position, a second link 2*b* rotatably connected to a lower end of the first link 2*a*, and a third link 2*c* rotatably connected to a lower end of the second link 2*b*. A lower end of the third link 2*c* is connected to the push link 3.

The switching mechanism for a motor protection circuit breaker according to the present invention further comprises a latch 10 connected to the link mechanism 2, and displaceable to a position for locking the link mechanism 2 and a position for releasing the locked state of the link mechanism 2. A latch holder (not shown) may be installed above the latch 10 so as to be rotatable to a position for locking the latch 10 or a position for releasing the locked state of the latch 10.

The switching mechanism for a motor protection circuit breaker according to the present invention comprises a movable contact mechanism 6, 7*a*, 7*a*-1, 7*b*, 7*b*-1, 7*c*, 7*c*-1 movable to a position contacting the fixed contacts 8, or to a position separated from the fixed contacts 8 according to whether a pressure by the push link 3 exists or not. When the motor protection circuit breaker according to the present invention is applied to three-phase alternating current motors, the fixed contact 8 is provided in six totally, i.e., three fixed contacts 8 are provided at an electric load sides and three fixed contacts 8 are provided at an electric power source sides. Among the fixed contacts 8, the end exposed to the outside of the motor protection circuit breaker is provided with a terminal portion 9 that can be connected to an external wire of the electrical power source side or an external wire of the electrical load side (motor side).

The movable contact mechanism 6, 7*a*, 7*a*-1, 7*b*, 7*b*-1, 7*c*, 7*c*-1 includes a cross bar 6, movable contact plates 7*a*, 7*b*, 7*c*, and movable contacts 7*a*-1, 7*b*-1, 7*c*-1.

The cross bar 6 may be commonly connected to the movable contact plates 7*a*, 7*b*, 7*c* so as to simultaneously open or close the movable contact plates 7*a*, 7*b*, 7*c* for three-phase, or may be integrally formed with the movable contact plates 7*a*, 7*b*, 7*c*.

The movable contact plates 7*a*, 7*b*, 7*c* support the movable contacts 7*a*-1, 7*b*-1, 7*c*-1, and are movable in a vertical direction (downward direction) by a pressure applied from the cross bar 6.

The movable contacts 7*a*-1, 7*b*-1, 7*c*-1 are attached to the movable contact plates 7*a*, 7*b*, 7*c*, and are movable in a vertical direction together with the movable contact plates 7*a*, 7*b*, 7*c*. Accordingly, the movable contacts 7*a*-1, 7*b*-1, 7*c*-1 are movable to an 'ON' position contacting the fixed contacts 8, or an 'OFF' position or a 'TRIP' position separated from the fixed contacts 8.

Contact pressure springs 11 for providing an elastic force in a direction contacting the fixed contacts 8 (upper direction) are installed below the movable contact plates 7*a*, 7*b*, 7*c*.

Hereinafter, with reference to FIGS. 1 to 4, will be explained 'ON' and 'OFF' operations of the switching mechanism for a motor protection circuit breaker according to the present invention.

Figure 3:
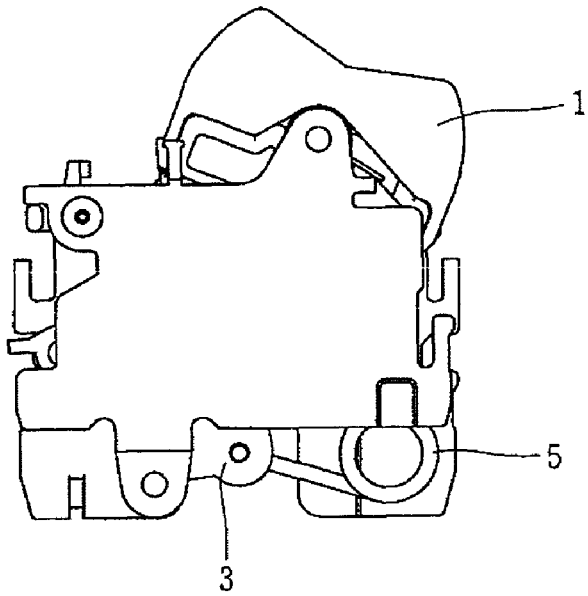
FIG. 3 is a view showing an 'ON' operation state of the switching mechanism for a motor protection circuit breaker according to the present invention.
Figure 4:
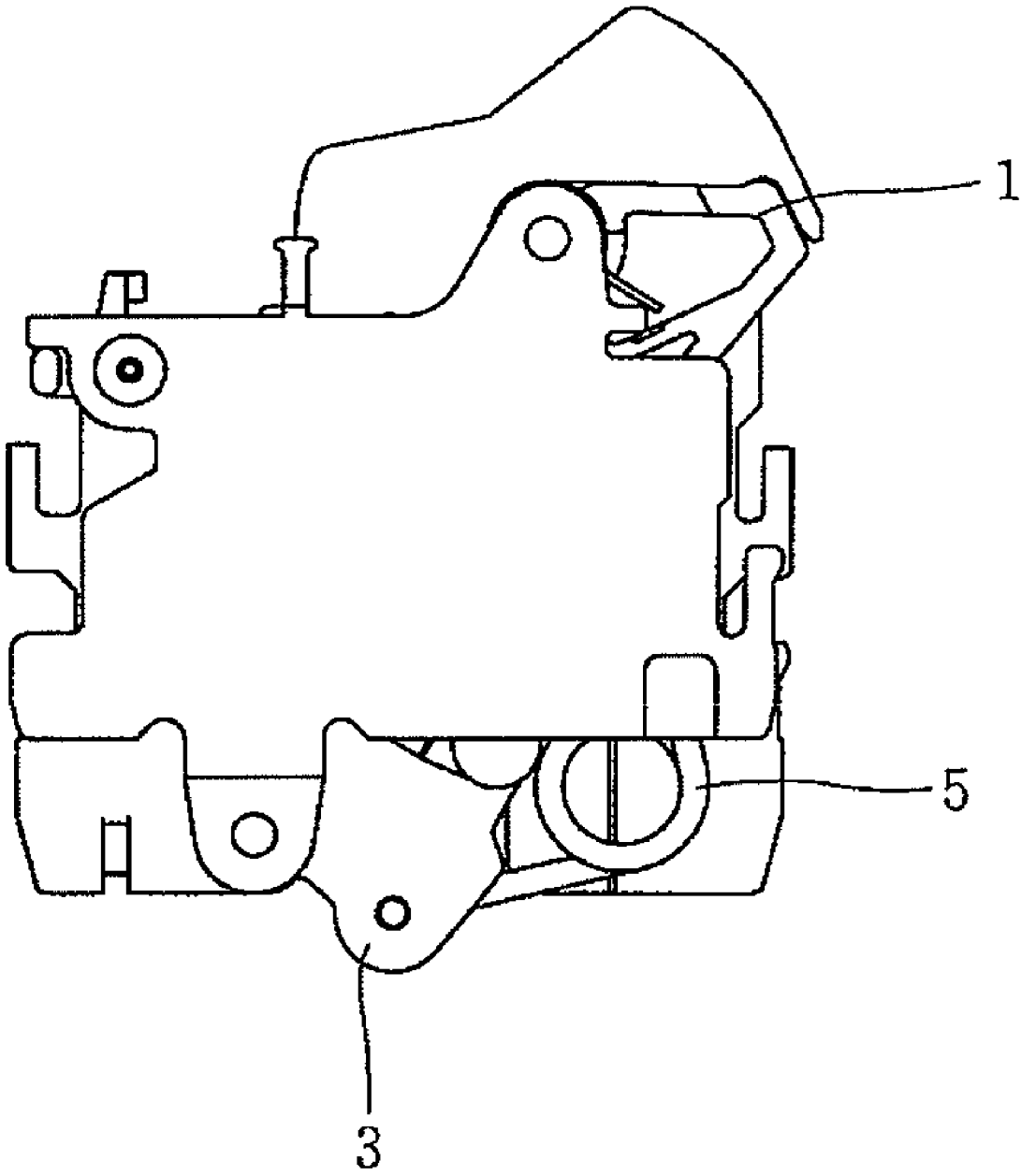
FIG. 4 is a view showing an 'OFF' operation state of the switching mechanism for a motor protection circuit breaker according to the present invention.

FIG. 3 is a view showing an 'ON' operation state of the switching mechanism for a motor protection circuit breaker according to the present invention, and FIG. 4 is a view showing an 'OFF' operation state of the switching mechanism for a motor protection circuit breaker according to the present invention.

Once the handle 1 is clockwise rotated by being pressed by a user to an 'ON' position from an 'OFF' state shown in FIG. 4, the push link 3 is counterclockwise rotated by the link mechanism 2 thus to be in a position shown in FIG. 3. Here, the second outer circumferential portion 3*b* of the push link 3 is in a position rotated by about 90° from a position facing the movable contact plates. And, the push link 3 stops the pressing of the movable contact plates 7*a*, 7*b*, 7*c* through the cross bar 6 disposed therebelow in FIG. 1. Accordingly, while the movable contact plates 7*a*, 7*b*, 7*c* are upwardly moved by an elastic force of the contact pressure springs 11, the movable contacts 7*a*-1, 7*b*-1, 7*c*-1 come in contact with the fixed contacts 8. As a result, implemented is an 'ON' state (position), i.e., a conducting state that a current can flow to the electrical load side (motor side) through the motor protection circuit breaker.

Once the handle 1 is counterclockwise rotated by being pressed by the user to an 'OFF' position from the 'ON' state shown in FIG. 3, the push link 3 is clockwise rotated by the link mechanism 2 thus to be in a position shown in FIG. 4. Here, the second outer circumferential portion 3*b* of the push link 3 is in a position facing the movable contact plates. And, the push link 3 presses the movable contact plates 7*a*, 7*b*, 7*c* through the cross bar 6 disposed therebelow in FIG. 1. By this pressure, the movable contact plates 7*a*, 7*b*, 7*c* are downwardly moved with overcoming the elastic force of the contact pressure springs 11. Accordingly, the movable contacts 7*a*-1, 7*b*-1, 7*c*-1 are separated from the fixed contacts 8. As a result, implemented is an 'OFF' state (position), i.e., a state that an electrical power supply to the electrical load side (motor side) through the motor protection circuit breaker is cut-off.

Differently from the above manual operation, a trip detection mechanism (not shown) such as an electromagnetic actuator detects the occurrence of an abnormal current such as a short current on the circuit. In this case, the trip detection mechanism rotates a latch holder (not shown) to a releasing position, thereby releasing the latch 10. Then, the trip spring 5 discharges charged elastic energy, and thus the push link 3 connected to the trip spring 5 is clockwise rotated to press the movable contact plates 7*a*, 7*b*, 7*c* through the cross bar 6 disposed therebelow. By this pressure, the movable contact plates 7*a*, 7*b*, 7*c* are downwardly moved with overcoming the elastic force of the contact pressure springs 11. Accordingly, the movable contacts 7*a*-1, 7*b*-1, 7*c*-1 are separated from the fixed contacts 8. As a result, implemented is a 'TRIP' state (position), i.e., a state that the electric power supply to the electric load side (motor side) through the motor protection circuit breaker is automatically cut-off.

As aforementioned, the switching mechanism for a motor protection circuit breaker according to the present invention comprises the push link having an outer circumferential curved surface of a varying cam profile. Accordingly, when the outer circumferential surface having a larger curvature radius of the push link pushes the cross bar, the movable contact plates can be vertically moved by a large displacement amount. This makes a spacing distance of the movable contacts from the fixed contacts long. The movable contact plates can make a large displacement even by a small rotation angle of the push link, thereby enhancing a function to break the circuit.

In the switching mechanism for a motor protection circuit breaker according to the present invention, the outer circumferential curved surface of the push link includes a first outer circumferential portion having a first curvature radius, and a second outer circumferential portion having a second curvature radius larger than the first curvature radius by a predetermined size. Accordingly, when the second outer circumferential portion having a larger curvature radius of the push link pushes the cross bar, the movable contact plates can be vertically moved by a large displacement amount. This makes a spacing distance of the movable contacts from the fixed contacts long. The movable contact plates can make a large displacement even by a small rotation angle of the push link, thereby enhancing a function to break the circuit.

In the switching mechanism for a motor protection circuit breaker according to the present invention, the second outer circumferential portion of the push link is positioned to face the movable contact plates only in a 'TRIP' position or an 'OFF' position, while being disposed in a position separated from the cross bar by a predetermined distance in an 'ON' position. As a result, the movable contact plates are upwardly pushed by the contact pressure springs, and thus the movable contacts come in contact with the fixed contacts. This may allow an 'ON' operation to be smoothly implemented.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A switch for a motor protection circuit breaker, the switch comprising:

a push link having an outer circumferential curved surface of a varying cam profile, so as to enhance a function to break a circuit by pressing movable contact plates, the outer circumferential curved surface of the push link comprising:

a first outer circumferential portion having a first curvature radius; and a second outer circumferential portion having a second curvature radius larger than the first curvature radius by a predetermined size, wherein the first outer circumferential portion intersects the second outer circumferential portion.

2. The switch according to claim 1, wherein the predetermined size is 1.5 mm.

3. The switch according to claim 1, wherein the second outer circumferential portion of the push link is positioned to face the movable contact plates only in a 'TRIP' position or an 'OFF' position.

4. A switch for a motor protection circuit breaker, the switch comprising:

a handle configured to manually adjust a motor protection circuit breaker to an 'ON' position or an 'OFF' position;

fixed contacts;

movable contacts configured to be movable to an 'ON' position contacting the fixed contacts, an 'OFF' position or a 'TRIP' position separated from the fixed contacts;

movable contact plates configured to support the movable contacts;

a link mechanism connected to the handle, and configured to transmit a manual operating force;

a latch connected to the link mechanism, and displaceable to a position for locking the link mechanism and a position for releasing the locked state of the link mechanism; and a trip spring configured to provide a driving force for breaking a circuit, wherein the switch further comprises a push link rotatable to a position to break the circuit by pressing the movable contact plates, and to a position for stopping the pressing of the movable contact plates, having a part connected to the link mechanism and a part connected to the trip spring, and having an outer circumferential curved surface of a varying cam profile so as to enhance a function to break the circuit by pressing the movable contact plates, the outer circumferential curved surface of the push link comprising:

a first outer circumferential portion having a first curvature radius; and a second outer circumferential portion having a second curvature radius larger than the first curvature radius by a predetermined size, wherein the first outer circumferential portion intersects the second outer circumferential portion.

5. The switch according to claim 4, wherein the predetermined size is 1.5 mm.

6. The switch according to claim 4, wherein the second outer circumferential portion of the push link is positioned to face the movable contact plates only in a 'TRIP' position or an 'OFF' position.

* * * * *